US008091502B2

(12) United States Patent
Haller

(10) Patent No.: US 8,091,502 B2
(45) Date of Patent: Jan. 10, 2012

(54) BACKBONE

(75) Inventor: Clay Haller, Concord, CA (US)

(73) Assignee: Advanced Elements, Inc., Concord, CA (US)

( * ) Notice: Subject to any disclaimer, the term of this patent is extended or adjusted under 35 U.S.C. 154(b) by 1047 days.

(21) Appl. No.: 11/824,929

(22) Filed: Jul. 3, 2007

(65) Prior Publication Data

US 2009/0007837 A1 Jan. 8, 2009

(51) Int. Cl.
*B63B 35/00* (2006.01)

(52) U.S. Cl. ..... 114/345; 114/347

(58) Field of Classification Search ..... 114/345, 114/347; 441/40; 440/40
See application file for complete search history.

(56) References Cited

U.S. PATENT DOCUMENTS

| | | | | | |
|---|---|---|---|---|---|
| 4,356 | A | * | 1/1846 | Day | 441/40 |
| 4,251,893 | A | * | 2/1981 | McCrory et al. | 114/345 |
| 4,795,387 | A | * | 1/1989 | Morgan | 441/130 |
| 4,807,555 | A | * | 2/1989 | Hart | 114/345 |
| 5,875,731 | A | * | 3/1999 | Abernethy et al. | 114/354 |

* cited by examiner

*Primary Examiner* — Edwin Swinehart
(74) *Attorney, Agent, or Firm* — Bay Area Technology Law Group PC

(57) ABSTRACT

A stiffening spine for use in a selectively inflatable kayak. Inflatable kayaks are characterized as having an elongated pneumatically inflatable peripheral tubes which, when inflated, define a passenger compartment and relatively narrow bow and stem sections. A flexible cover extends between and at least partially encases the elongated pneumatically inflatable peripheral tubes to provide a floor for the kayak. A spine for stiffening the inflatable kayak is provided in the form of a relatively rigid longitudinal member and end caps fitted to both ends thereof. The longitudinal member is sized to be removably inserted within the flexible cover so that when installed, the end caps are positioned proximate the bow and stem sections of the inflatable kayak.

6 Claims, 2 Drawing Sheets

BACKBONE

TECHNICAL FIELD

The present invention deals with a selectively inflatable watercraft which can be stored in relatively compact volumes which are pneumatically inflatable to provide full functional kayaks for single or multi passenger use. The present invention recognizes certain limitations inherent in inflatable watercraft and through the use of the present removable stiffening member, such inflatable watercraft are capable of exhibiting some of the same desirable characteristics of rigid non-collapsible kayaks of the prior art.

BACKGROUND OF THE INVENTION

There are many reasons why kayak users find inflatable products desirable. Not only are such products capable of being reduced to a relatively small compact size for storage, but an inflatable watercraft is the only viable option when one requires the ability to carry, via backpack, a watercraft to be used only selectively during combined land and water travail. Oftentimes, a backpacking experience involves hiking over an extended land mass coupled with a river or other water body boating experience. It is simply not practical to carry rigid non-collapsible watercraft, such as a kayak, over land to be used only when the trip involves aquatic activities.

Despite the obvious benefits inherent in inflatable kayaks, such collapsible watercraft have not been universally embraced. For anyone who has used products of this nature, their limitations are readily perceived. For example, most inflatable kayaks have no structural frame members and thus behave not like a rigid watercraft but instead like an undefined tubular member which rides atop the surface of a body of water and is difficult to navigate and is subject to control limitations. Bending and flexure in such watercraft provides undesirable characteristics which limit their universal acceptance despite the portability considerations cited above.

Recognizing this, others have suggested frame members which can be employed together with inflatable tubes to provide structures which more closely emulate the characteristics of non-collapsible canoes and kayaks. However, in dealing with rigid frame members, challenges exist in providing the necessary backpack portability sought after in adopting a pneumatically inflatable structure in the first instance. In other words, rigid frame-containing designs provide little or no improvement over rigid non-collapsible structures when it comes to portability.

It is thus an object of the present invention to provide a fully backpack transportable pneumatically inflatable kayak which inherently provides the advantages of the prior art while avoiding its limitations.

It is yet a further object of the present invention to provide a pneumatically inflatable kayak, which upon assembly, inherently provides the sought after aerodynamic and control attributes inherent in a rigid or framed structure which provide the necessary compact size sought after by backpackers.

These and further objects will be more readily apparent when considering the following disclosure and appended claims.

SUMMARY OF THE INVENTION

The present invention involves a spine for stiffening an inflatable kayak. The selectively inflatable kayak comprises at least one elongated pneumatically inflatable peripheral tube which when inflated defines a passenger compartment and relatively narrow bow and stem sections and a flexible cover extending between and at least partially encasing the at least one elongated pneumatically inflatable peripheral tube to provide a floor for the kayak. The improvement comprises a spine for stiffening the inflatable kayak, the spine comprising a relatively rigid longitudinal member and end caps fitted to both ends thereof. The longitudinal member is sized to be removably inserted within said flexible cover so that when installed, said end caps are positioned proximate the bow and stem sections of said inflatable kayak.

DETAILED DESCRIPTION OF THE INVENTION

Figure 3:
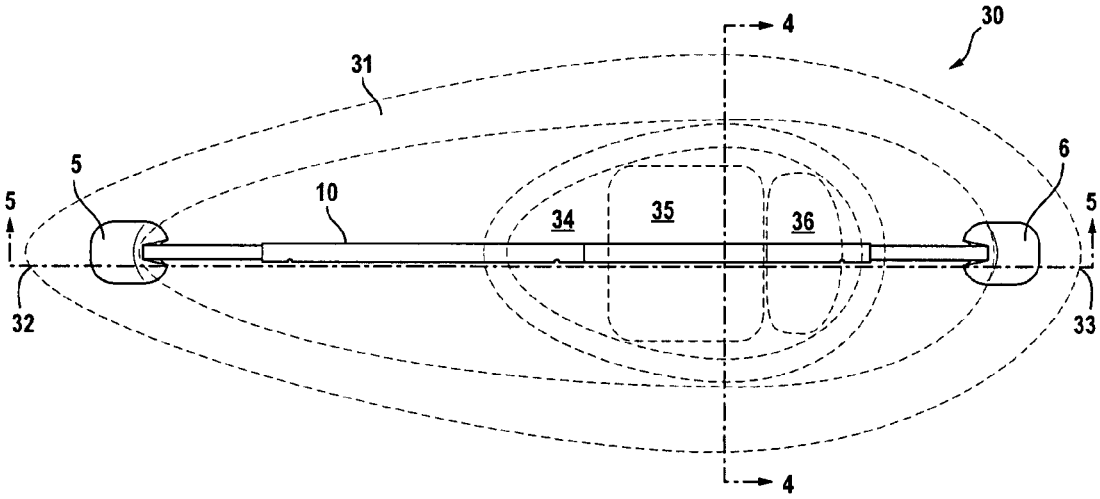
FIG. 3 is a top plan view of the spine of the present invention shown installed in a typical inflatable kayak.
Figure 4:
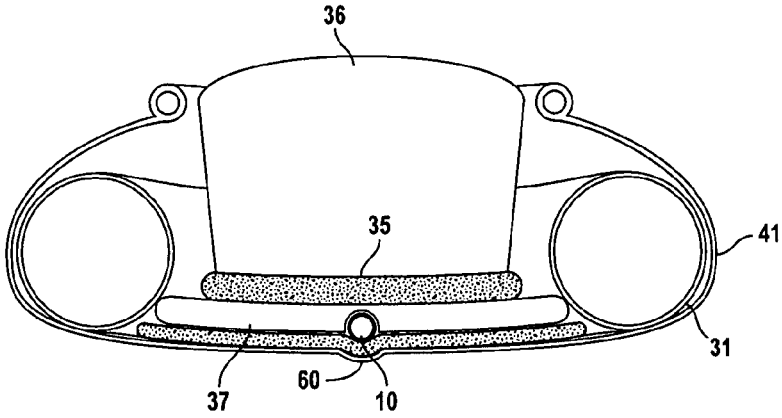
FIG. 4 is a cross sectional view of the spine/kayak combination of FIG. 3 taken along line 4-4.

Turning first to FIG. 3, kayak 30 is shown having bow section 32 and stern section 33 defined by elongated pneumatically inflatable peripheral tube 31. When tube 31 is inflated, it defines passenger compartment 34 in which seat 35 and back rest 36 are situated to receive a user of kayak 30. As best visualized by reference to FIGS. 4 and 5, elongated pneumatically inflatable peripheral tube 31 is situated within flexible cover 41 extending between and at least partially encasing said elongated pneumatically inflatable peripheral tube 31 to provide a floor for kayak 30.

Figure 1:
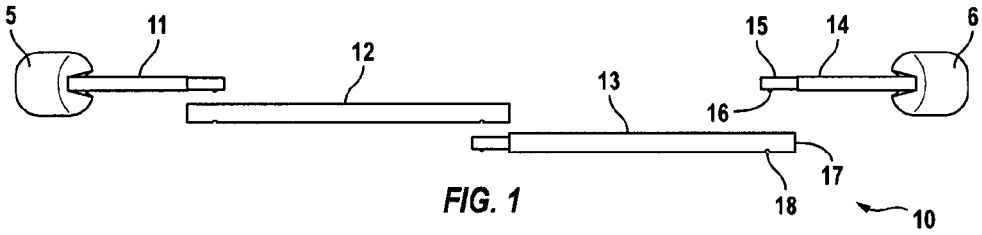
FIG. 1 is a side plan view of a spine of the present invention being disassembled for storage and carrying.
Figure 2:
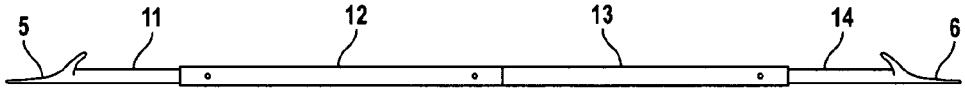
FIG. 2 is a side plan view of the spine of FIG. 1 once assembled.

In order to achieve the benefits of the present invention, kayak 30 is provided with spine 10 for stiffening inflatable kayak 30. Spine 10 comprises a relatively rigid longitudinal member shown made up in a plurality of sections 11, 12, 13 and 14 capable of being disassembled from one another as depicted in FIG. 1 for storing and carrying said spine. Ideally, each section, such as section 14 is provided with reduced cross-sectional member 15 bearing spring loaded button latch 16 for being received within end 17 of section 13 such that spring loaded button latch 16 seats within opening 18 when assembled. For disassembly, finger or thumb pressure on spring loaded button latch 16 removes it from engagement with opening 18 whereby sections 14 and 13 can be pulled apart from one another as shown. FIG. 2 shows these various elements in their assembled state.

Figure 6:
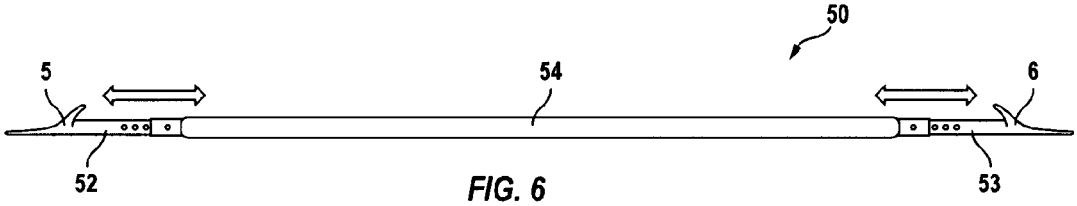
FIG. 6 is a side plan view of a second embodiment of a spine of the present invention.

Reference is made to FIG. 6 showing an alternative embodiment to spine 10. Specifically, spine 50 is constructed as a telescoping member whereby reduced cross section end pieces 52 and 53, supporting end caps 5 and 6 telescope into expanded cross section segment 54 selectively for storage and drawn there from during use.

Figure 5:
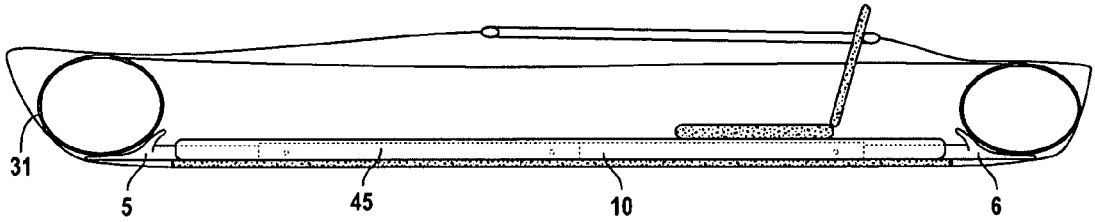
FIG. 5 is a side view of the spine/kayak combination of FIG. 3 taken along line 5-5.

In use, spine 10 or 50 is inserted within kayak 30 so that when installed, end caps 5 and 6 located at the extreme ends of spine 10 or 50 are positioned proximate bow and stern ends 32 and 33. To maintain the appropriate positioning of spine 10 or 50, the stiffening member ideally travels beneath seat cushion 37 and end caps 5 and 6 snuggly tucked between elongated pneumatically inflatable peripheral tube 31 and flexible cover 41 as best shown in FIG. 5. The pressure between elongated pneumatically inflatable peripheral tube 31 and flexible cover 41 helps to maintain spine 10 or 50 in position during use.

Spine 10 is ideally composed of separate disengageable portions 11, 12, 13 and 14 although any number of sections can be provided depending upon the size of the collapsed package to be transported by backpack or otherwise in employing the present invention. These various component parts can be made of any relatively rigid elongated members of, for example, aluminum, steel or plastic. End caps 5 and 6 are ideally composed of plastic. Some flexure of spine 10 or 50 is acceptable noting that such flexure would be relatively little in comparison to the natural bending moment experienced by using an inflatable kayak without auxiliary structural support.

In that, when employed, spine 10 or 50 is intended to run along the inner surface of flexible cover 41, it is ideal to encapsulate spine 10 or 50, at least partially, with a cushioning membrane 45 to reduce kayak damage if the watercraft was to engage jagged rocks or other hazardous obstacles along its bottom surface across from the location of spine 10. The spine also creates a slight v-shaped bulge 60 in the bottom surface of the kayak. This improves tracking, i.e., paddling in a straight line and speed.

What is claimed is:

1. In a selectively inflatable kayak comprising at least one elongated pneumatically inflatable peripheral tube which when inflated, defines a passenger compartment and relatively narrow bow and stern sections and a flexible cover extending between and at least partially encasing said at least one elongated pneumatically inflatable peripheral tube to provide a floor for said kayak, the improvement comprising a spine for stiffening said inflatable kayak, said spine comprising a relatively rigid longitudinal member and end caps fitted to both ends thereof, said longitudinal member being sized to be removably inserted within said flexible cover so that when installed, said end caps are positioned proximate the bow and stern sections of said inflatable kayak.

2. The spine of claim 1 wherein said relatively rigid longitudinal member comprises a plurality of sections capable of being disassembled from one another for storing and carrying said spine.

3. The spine of claim 1 wherein said longitudinal member is at least partially coated with a cushioning layer.

4. The spine of claim 1 wherein said longitudinal member, when removably inserted within the kayak positions said end caps between said elongated pneumatically inflatable peripheral tube and said flexible cover proximate said bow and stern sections.

5. The spine of claim 1 wherein said relatively rigid longitudinal member comprises a plurality of sections capable of telescoping within one another for storage and carrying said spine.

6. The selectively inflatable kayak of claim 4 wherein said spine creates a bulge in the bottom surface of the kayak.

* * * * *